United States Patent [19]

Gacka et al.

[11] Patent Number: 4,815,666

[45] Date of Patent: Mar. 28, 1989

[54] POWDER SPRAY GUN FOR QUICK COLOR CHANGES SYSTEMS

[75] Inventors: Mark Gacka, Lakewood; Thomas E. Hollstein, Amherst; John C. Traylor, Elyria, all of Ohio

[73] Assignee: Nordson Corporation, Westlake, Ohio

[21] Appl. No.: 99,495

[22] Filed: Sep. 21, 1987

[51] Int. Cl.[4] ..... B05B 5/04

[52] U.S. Cl. ..... 239/697; 239/456; 239/514; 239/600; 239/706

[58] Field of Search ..... 239/3, 11, 600, 707, 239/697, 704, 706, 456–458, 505, 513–515

[56] References Cited

U.S. PATENT DOCUMENTS

| | | | |
|---|---|---|---|
| 3,667,674 | 6/1972 | Parsons et al. | 239/698 |
| 3,746,254 | 7/1973 | Duncan et al. | 239/15 |
| 3,777,981 | 12/1973 | Probst et al. | 239/1 |
| 3,844,477 | 10/1974 | Pollard et al. | 239/15 |
| 4,248,379 | 2/1981 | Hollstein et al. | 239/1 |
| 4,380,320 | 4/1983 | Hollstein et al. | 239/697 |
| 4,630,777 | 12/1986 | Hollstein et al. | 239/707 |
| 4,634,058 | 1/1987 | Hollstein et al. | 239/698 |

*Primary Examiner*—Andres Kashnikow
*Assistant Examiner*—Karen B. Merritt
*Attorney, Agent, or Firm*—Wood, Herron & Evans

[57] ABSTRACT

A powder spray gun for use in spraying particulate powder material of different colors is constructed of a number of individual parts which are quickly and easily disassembled from one another so that each part which comes into contact with particulate powder material can be individually cleaned in changing over from one powder to another. The powder spray gun comprises a mounting block which carries a rearward barrel member and a powder inlet tube, a forward barrel member connected to the rearward barrel member, a nozzle and pattern adjustment sleeve both carried on the forward barrel member and an electrostatic cable assembly received within a barrel liner which extend axially along the length of the spray gun. All but one of the connections between these parts are made by O-rings which frictionally engage facing surfaces of the parts so that they are easily pulled apart, cleaned by a jet of air or the like and then reassembled in preparation for spraying another color of particulate powder material.

14 Claims, 2 Drawing Sheets

POWDER SPRAY GUN FOR QUICK COLOR CHANGES SYSTEMS

FIELD OF THE INVENTION

This invention relates to particulate powder spray guns, and, more particularly, to a powder spray gun which is quickly disassembled into a number of separate parts for cleaning in preparation to convert from one color of powder spray material to another, and then quickly reassembled to resume operation.

BACKGROUND OF THE INVENTION

The process of spraying products with a solid powder coating involves preparing the powder coating in finely ground form and spraying it onto the parts in a manner similar to liquid paint. Conventionally, but not necessarily, an electrostatic charge is applied to the powder as it is sprayed toward an object to be coated. The object to be coated is maintained at an electrostatic potential different from that of the charged powder particles so that the particulate powder material is attracted to the article and deposited thereon with improved efficiency and coverage. The electrostatic charge maintains the powder on the product for a sufficient time period to permit the powder to be heated so that it melts, and when subsequently cooled the powder is firmly attached to the target substrate.

In industrial finishing applications for particulate powder materials, it is often necessary to change the color of the powder coating material from time to time. One approach in the prior art to convert from one color to another has been to employ multiple spray guns each connected to separate supply lines which deliver a different color of particulate powder material to each gun. These systems include controls upstream from the powder spray guns to control the flow of powder material so that when one color is desired the supply line carrying such color is opened and the other supply lines are closed. Although this system is effective in quickly changing from one color to another, it requires the use of a number of spray guns and a control system for opening and closing the separate supply lines to each spray gun. As a result, such systems are relatively costly to purchase and maintain.

Prior art systems for changing from one color of particulate powder material to another have also been proposed which incorporate a single spray gun connected to a multi-ported manifold. Supply lines from sources of a number of different colors of powder material are connected to the manifold and then via the manifold to one spray gun. See, for example, U.S. Pat. No. 4,248,379 which is assigned to the same assignee as this invention. In changing from one color of particulate powder material to another, a pressurized flow of air is employed to purge the manifold, the feed line leading from the manifold to the spray gun, and the interior surfaces of the spray gun which come into contact with the powder. This purging flow of air is directed through the spray gun while maintaining it assembled, and in position within a powder spray booth or other enclosed powder spraying apparatus.

One limitation of prior art systems of the type disclosed in U.S. Pat. No. 4,248,379, is that it may be difficult to completely clean each part of the spray gun which contacts the powder without disassembling such parts. This is particularly true where there are bends or corners in the powder path formed by parts of the spray gun within which the finely ground powder material can lodge. Additionally, no provision is made in such a powder cleaning system to remove powder coating material from the outside of the spray gun. If any remnants of a first color of particulate powder material remain on the interior or exterior surfaces of the gun when a particulate powder material of a second color is discharged therethrough, these colors can combine to produce an unacceptable coating when the production run is first resumed.

SUMMARY OF THE INVENTION

It is therefore among the objectives of this invention to provide a powder spray gun for use in a system adapted to spray a variety of colors of particulate powder material which is easily and completely cleaned in converting from one color of particulate powder material to another, and which provides for a uniform distribution of particulate powder material on an object to be coated.

These objectives are accomplished in a powder spray gun constructed of a number of individual parts which are quickly and easily disassembled from one another so that the interior and exterior surfaces of each part which comes into contact with the particulate powder material can be individually cleaned by a blast of air. The separate, cleaned parts are then easily reassembled to begin another production run with a different color of particulate powder material. The powder spray gun herein comprises a mounting block which carries a rearward barrel member and a powder supply tube. A forward barrel member is connected to the rearward barrel member, and the forward barrel member mounts a nozzle and a pattern adjustment sleeve at its forward end. A barrel liner, extending through the forward and rearward barrel members and nozzle, receives an electrostatic cable which is supported at the rearward end by the mounting block and at the forward end by a cable liner mount.

With the exception of the forward and rearward barrel members which are connected together by a threaded connection, all of the parts of the spray gun which come into contact with the particulate powder material are slidably mounted to one another using O-rings to create a friction fit therebetween which maintain such parts in assembled relation. The powder supply tube, forward and rearward barrel members, barrel liner, cable liner mount, nozzle and pattern adjustment sleeve can therefore be easily separated from one another. Preferably, each of these parts is also formed with a substantially straight powder flow passageway which is directly accessible by a jet of air so that any powder thereon is easily removed.

In the presently preferred embodiment, the mounting block is formed with an inlet which is adapted t mount an electrostatic cable carried within a cable liner. The cable and cable liner extend from the rearward end to the forward end of the gun and are of the type disclosed in the co-pending patent application, Ser. No. 07/054,746, filed entitled "Electrostatic Spray Gun Device and Cable Assembly".

The mounting block is formed with a cavity which receives a rearward barrel member having an O-ring carried on its outer surface which contacts the walls of the cavity in the mounting block to secure the rearward barrel member thereto. A throughbore is formed in the rearward barrel member which receives the cable liner and cable. A powder delivery tube is slidably connected within a port formed in the rearward barrel member, and is adapted to supply powder to the gun from a source of particulate powder material. In the presently preferred embodiment, the powder supply tube is positioned at an angle of less than 30° relative to the longitudinal axis of throughbore in the rearward barrel member to reduce impact fusion and wear of the particulate powder material with the inner surfaces of the spray gun.

A forward barrel member is connected by a threaded connection to the rearward barrel member and is formed with a throughbore which receives the cable liner and cable. The outer surface of the forward barrel member is stepped forming first and second annular shoulders.

A barrel liner is inserted within the throughbores of the forward and rearward barrel members and is mounted at one end to a seat formed in the forward barrel member. The barrel liner is formed with a throughbore which receives the cable liner thus shielding it from contact with the particulate powder material flowing through the forward and rearward barrel members.

A pattern adjusting sleeve is slidably mounted onto the outer surface of the forward barrel member and has an O-ring carried in a groove formed in the inner wall thereof which engages the outer surface of the forward barrel member to retain the pattern adjusting sleeve in position thereon.

A nozzle having an hourglass-shaped throughbore is inserted within a throughbore formed in the pattern adjusting sleeve. The nozzle is carried on the outer surface of the forward barrel member and has an end formed to abut the first shoulder of the forward barrel member. O-rings carried in grooves formed in the forward end of the forward barrel member engage the nozzle to retain it in position thereon.

The cable liner and cable extend outwardly from the forward barrel member into the throughbore formed in the nozzle. A cable liner mount is inserted within the throughbore formed in the nozzle and rides on the outer surface of the forward barrel member in abutment with the second annular shoulder formed on the outer surface of the forward barrel member. The cable liner mount supports the forward end of the cable liner and cable so as to concentrically dispose the cable relative to the throughbore formed in the nozzle. Preferably, the throughbore formed in the forward barrel member increases in diameter upstream from the cable liner mount to decrease the velocity of the particulate powder material thereat. This ensures that the powder is uniformly distributed entering the nozzle after contacting the cable liner mount.

The forwardly extending end of the cable liner mounts a particle deflector of the type disclosed in U.S. patent application Ser. No. 07/072,780, filed July 13, 1987, and entitled "Particle Spray Gun". This particle deflector contains an electrode in the form of an annular, resistive sheet of mesh material which is electrically connected to the cable in the cable mount.

Particulate powder material is introduced through the powder supply tube into the rearward barrel member, and then through the forward barrel member and nozzle for discharge onto an object to be coated. In the course of flowing through the spray gun, the powder comes into contact with the rearward barrel member, the barrel liner which covers the cable and cable liner, the forward barrel member, the cable liner mount, the nozzle and the pattern adjustment sleeve.

An important aspect of this invention is that each of these parts of the spray gun which come into contact with the powder material are constructed to permit easy separation from one another for cleaning. There are no sharp corners, bends or other areas on any of the internal walls of the parts of the spray gun which are likely to trap the powder and thus complete cleaning of both their inner and outer surfaces can be achieved rapidly by a jet of air. Additionally, the internal walls of the parts of the spray gun are formed to ensure thorough mixing of the particulate powder material flowing therethrough to improve the uniformity of the spray pattern of particulate powder material on the object to be coated.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 3:
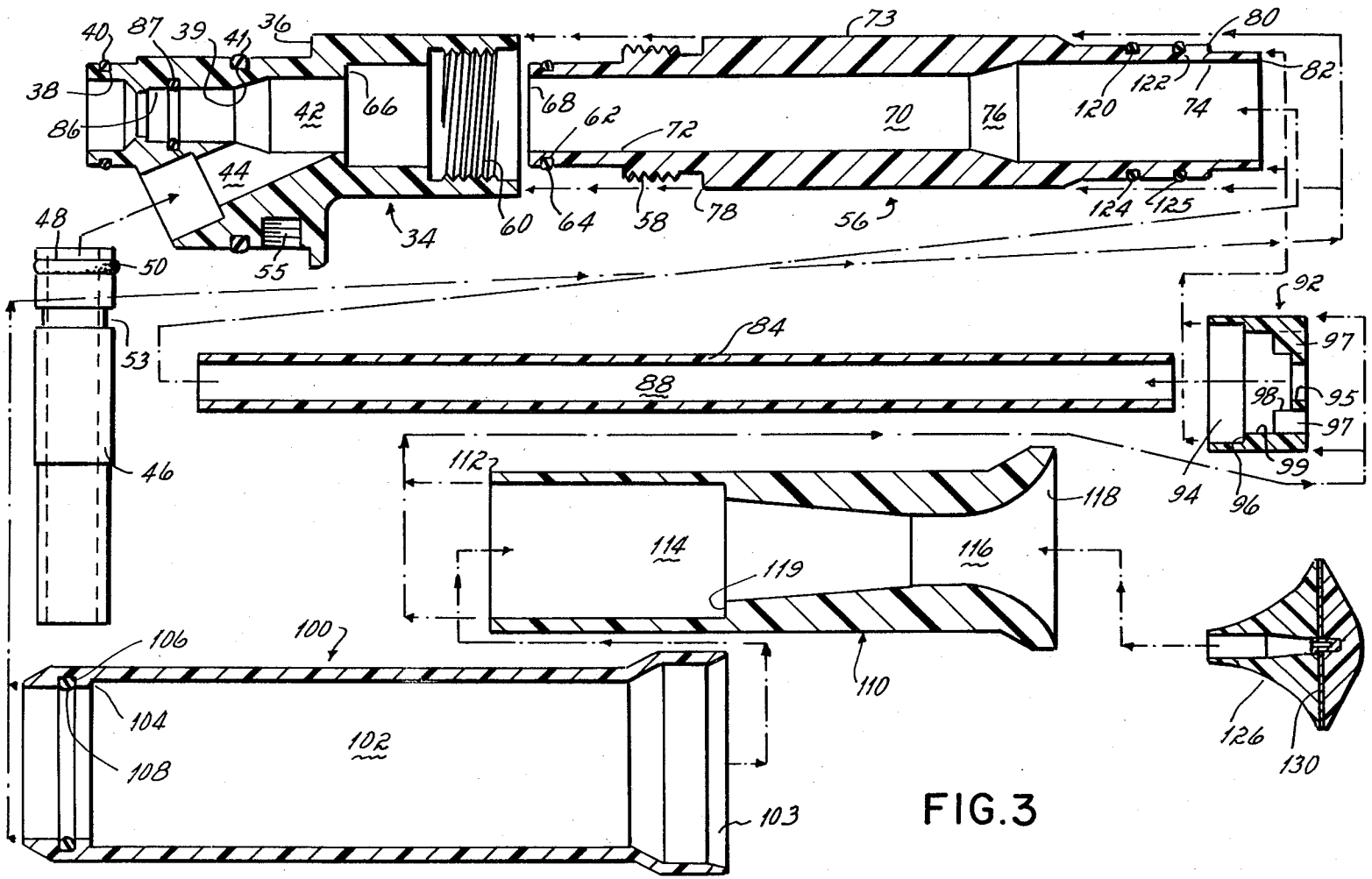
FIG. 3 is a completely disassembled view of the spray gun herein showing how the parts are assembled together once disassembled.

Referring now to the FIGS., a powder spray gun 10 is illustrated for applying particulate powder material to an object to be coated (not shown). The powder spray gun 10 consists of a number of parts which are constructed to permit easy assembly and disassembly of the spray gun 10 for cleaning or maintenance. The structure of each part of the powder spray gun 10 is described first, and then the sequence for assembly of the parts is discussed as illustrated in FIG. 3. For purposes of the present discussion, the term "forward" refers to the righthand portion of the spray gun 10 as viewed in FIG. 1, and the term "rearward" refers to the opposite, lefthand portion of such figure. Additionally, each part of the spray gun 10 described below is preferably formed of a material such as polytetrafluoroethylene, polyethylene or similar materials which exhibit good non-conductivity, have good dimensional stability and machining properties and which are difficult to bond to, i.e., have low surface free energy.

The powder spray gun 10 comprises a mounting block 12 having a base 14 and a cap 16. The base 14 and cap 16 are each formed with a notch which together define a bore 18 adapted to receive a mounting rod 19 for supporting the powder spray gun 10. See FIG. 2. The base 14 and cap 16 are mounted to one another by screws 20.

The base 14 of mounting block 12 is formed with an inlet sleeve 22 which is adapted o mount a cable adjustment assembly 24. The cable adjustment assembly 24 is mounted to an electrostatic cable 26 and to a dielectric cable liner 28 which receives and insulates the electrostatic cable 26 from the inlet sleeve 22 to the forward end of the spray gun 10. As described in detail in U.S. patent application Ser. No. 07/054,746, filed May 27, 1987, and entitled "Electrostatic Spray Gun Device and Cable Assembly", the cable adjustment assembly 24 is operable to move the cable liner 28 and electrostatic cable 26 axially with respect to the powder spray gun 10. The cable adjustment assembly 24 forms no part of this invention per se, and reference should be made to the application of Ser. No. 07/054,746 for a detailed discussion thereof which is incorporated by reference in its entirety herein.

The forward portion of the base 14 of mounting block 12 is formed with a cavity 30 and a semi-circular angled notch or groove 32 which intersects the cavity 30 at the bottom of the mounting block base 14. The cavity 30 receives a rearward barrel member 34 having an outer surface formed with an annular shoulder 36 and a pair of annular groove 38, 39 positioned rearwardly of the shoulder 36. The annular grooves 38, 39 form seats for O-ring 40, 41, respectively, which engage the walls of the cavity 30 of mounting block 12 to retain the rearward barrel member 34 in position within the cavity 30 of the mounting block 12. In the assembled position, the annular shoulder 36 of rearward barrel member 34 contacts the forward face of the mounting block 12.

The rearward barrel member 34 is formed with a stepped throughbore 42 which receives the cable liner 28. A stepped, angled bore 44 is formed in the base of the rearward barrel member 34 which aligns with the groove 32 of mounting block 12 and intersects the throughbore 42 formed in the rearward barrel member 34. The bore 44 is formed at an angle of less than 30°, and preferably about 23°, relative to the longitudinal axis of the throughbore 42 in the rearward barrel member 34.

A powder inlet tube 46 is provided for delivering particulate powder material into the powder spray gun 10. The powder inlet tube 46 is connected at one end to a source of particulate powder material (not shown), and its opposite end is formed with a groove 48 which forms a seat for an O-ring 50. The forward end of the inlet tube 46 is received within the stepped angled bore 44. The O-ring 50 at the end of powder inlet tube 46 engages the wall of the rearward barrel member 34 formed by the angled bore 44 to create a seal therebetween. The powder inlet tube 46 is secured in place in the bore 44 by a tube retainer member 52. The member 52 is carried in a recess formed in the base 14 of mounting block 12, and mounts to the bottom of the rearward barrel member 34 by a screw 54 passing through the member 52 and threaded into a bore 55 in the rearward barrel member 34. A detent 51 on the forward end of member 52 seats within a portion of an annular groove 53 of tube 46 to securely fix the tube 46 within the rearward barrel member 34. The intermediate portion of feed tube 46, thus secured, is housed within the semi-circular angled groove 32.

The next forwardly extending portion of the powder spray gun 10 is a forward barrel member 56. The forward barrel member 56 is formed with a rearward end having external threads 58 which mate with corresponding internal threads 60 formed in the inner wall of the rearward barrel member 34 to connect the forward barrel member 56 to the rearward barrel member 34. In addition, the forward barrel member 56 is formed with a groove 62 at its rearward end forming a seat for an O-ring 64 which engages the wall of the rearward barrel member 34 formed by stepped throughbore 42. The O-ring 64 engages the walls of the stepped throughbore 42 formed in the rearward barrel member 34. Preferably, the stepped throughbore 42 forms an annular shoulder 66 against which the rearward end 68 of the forward barrel member 56 seats when the forward and rearward barrel members 56, 34 are assembled.

The forward barrel member 56 is formed with a throughbore 70, adapted to receive the cable liner 28 and cable 26, which increases in diameter from a rearward portion 72 to the forward portion 74 thereof, with a tapered, transitional portion 76 extending therebetween. The outer surface of forward barrel member 56 is stepped in two locations forming generally annular shoulders 78 and 80 thereat.

The forward and rearward barrel members 56, 34 receive a barrel liner 84 which is carried at its rearward end within a seat 86 formed by the stepped bore 42 in the rearward barrel member 34. An O-ring 87 is mounted in the wall of stepped throughbore 42 which engages the barrel liner 84 to retain it in place on seat 86. The barrel liner 84 has a throughbore 88 within which the cable liner 28 and electrostatic cable 26 are received and isolated from contact with particulate powder material flowing through the powder spray gun 10. The barrel liner 84 forms an annular passageway 90 through the forward and rearward barrel members 56, 34 for transmitting particulate powder material flowing into the spray gun 10 through the powder inlet tube 46.

Figure 1:
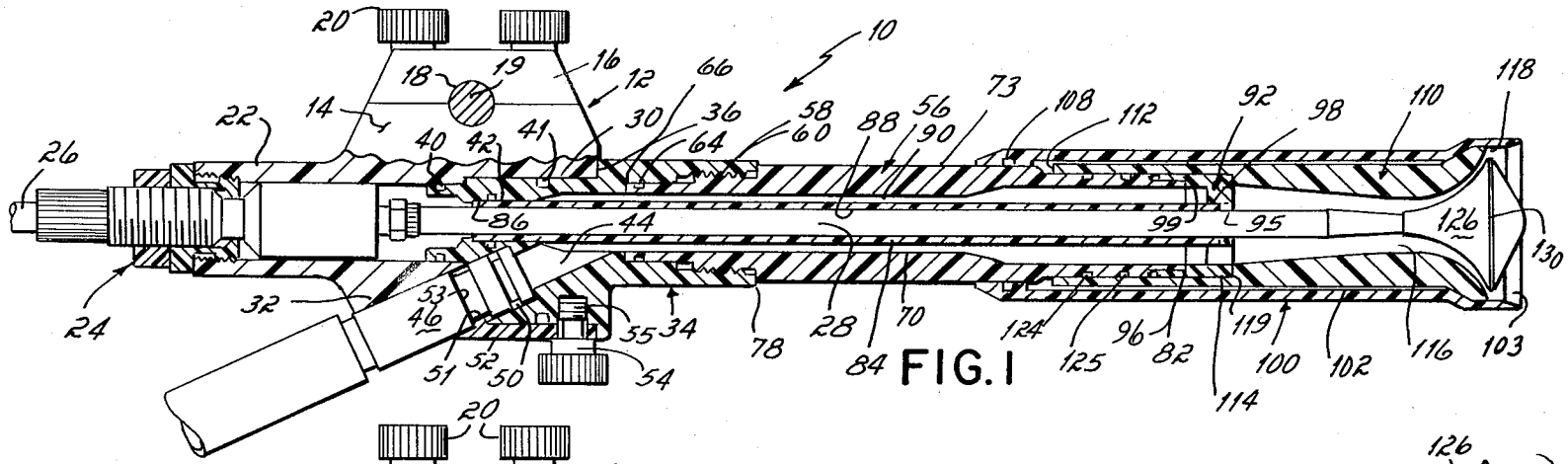
FIG. 1 is a cross sectional view of the assembled spray gun of this invention.

The forward end of the forward barrel member 56 mounts a cable liner support 92 having a stepped throughbore 94. A shoulder 96 formed by the stepped bore 94 of cable liner support 92 abuts the annular end edge 82 formed on the outer surface of forward barrel member 56. As best shown in FIG. 1, the forward end of barrel liner 84 is carried on shoulders 98 formed by a plurality of radial connectors 97 of cable liner support 92. In the presently preferred embodiment, there are three radial connectors 97 which extend radially outwardly at 120° intervals between an annular ring 95 at the center of cable liner support 92 and the inner wall 99 thereof. The forward end of cable liner 28 extends forwardly from the barrel liner 84 and then through the annular ring 95. The shoulders 98 of the connectors 97, and the annular ring 95, position the cable liner 28 concentric to the cable liner support 92, and, in turn, the forward and rearward barrel members 56, 34.

The forward barrel member 56 is formed with a center portion 73 which mounts a pattern adjustment sleeve 100. The pattern adjustment sleeve 100 has a throughbore 102 which expands in diameter at its forward end forming a chamfer 103 as shown in FIG. 3. The rearward end of throughbore 102 is formed with a step defining an annular shoulder 104. A groove 106 is formed at the rearward end of pattern adjustment sleeve 100 and this groove 106 forms a seat for an O-ring 108. The pattern adjustment sleeve 100 is inserted over the center portion 73 of forward barrel member 56 such that the O-ring 108 on the inner wall of pattern adjustment sleeve 100 engages forward barrel member 56 to retain them in assembled relation.

A powder spray nozzle 110 is received within the throughbore 102 of pattern adjustment sleeve 100. The nozzle 110 has a stepped throughbore 114 adapted to receive the forward end of cable liner 28 and electrostatic cable 26. The stepped throughbore 114 includes an hourglass portion 116 having a discharge opening 118 at the forward end and an annular shoulder 119 at the rearward end.

The nozzle 110 is slid over the forward end of forward barrel member 56 within the throughbore 102 of pattern adjustment sleeve 100 so that the annular shoulder 119 of nozzle 110 engages the forward end of the cable liner support 92. The outer surface of the forward barrel member 56 is formed with a pair of grooves 120, 122 each of which receive an O-ring 124, 125, respectively. The O-rings 124, 125 frictionally engage the inner wall of nozzle 110 and maintain it in position upon the forward barrel member 56. As shown in FIG. 1, the forward portion of the cable liner 28 and cable 26 extend into the throughbore 114 of nozzle 110 within the hourglass portion 116 thereof.

With the nozzle 110 and pattern adjustment sleeve 100 in position, a deflector 126 is inserted over a pin 128 extending outwardly from the forward end of the cable liner 28. As discussed in detail in U.S. patent application Ser. No. 07/054,746, mentioned above, the pin 128 is electrically connected to electrostatic cable 26, and, when mounted to the deflector 126, it provides an electrical path from the electrostatic cable 26 to an electrode 130 carried by the deflector 126. The electrode 130 is preferably an annular resistive sheet formed of a mesh material such as disclosed in U.S. patent application Ser. No. 07/072,780, filed July 13, 1987, and entitled "Particle Spray Gun", which is incorporated by reference in its entirety herein. The particular construction of the deflector 126 forms no part of this invention per se and is therefore not discussed in detail herein.

Figure 2:
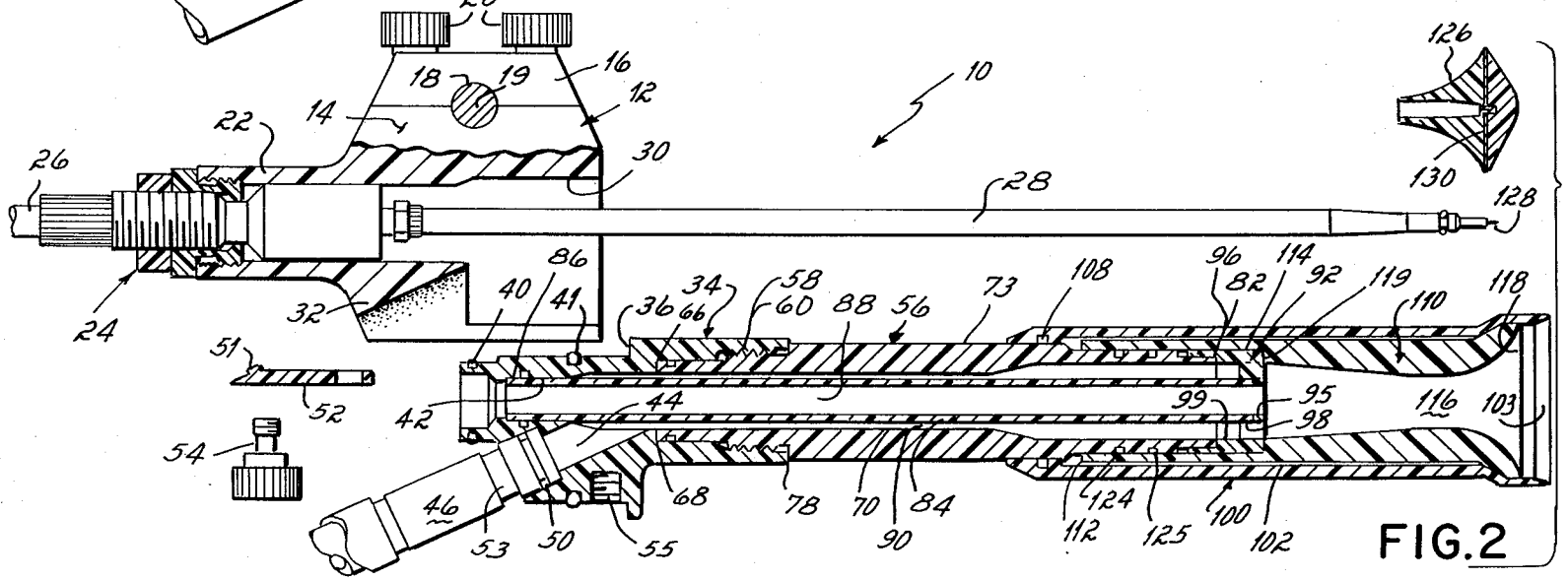
FIG. 2 is a partially disassembled view of the spray gun shown in FIG. 1 in which the parts which contact the particulate powder material are separated from those which do not come into contact with the particulate powder material.

Referring now to FIG. 2, the spray gun 10 is shown partially disassembled with those parts which contact particulate powder material separated from those which do not. As shown, the mounting block 12, and the electrostatic cable 26 and cable liner 28, are retained in an assembled relationship because they are not exposed to the flow of particulate powder material through powder spray gun 10 and need not be disassembled for cleaning. The parts shown in an assembled relationship at the lower portion of FIG. 2, except for retainer 52 and screw 54, come into contact with the particulate powder material. Particulate powder material (not shown) enters the powder spray gun 10 through the powder inlet tube 46 and then flows within the rearward barrel member 34, the forward barrel member 56, the nozzle 110 and then along the forwardmost edge of the pattern adjustment sleeve 100. The barrel liner 84 is centrally disposed along the rearward and forward barrel members 34, 56, and is thus also exposed to the particulate powder material flowing therethrough. Each of these parts, and the deflector 126, must be cleaned when changing from a powder material of one color to another.

In the presently preferred embodiment, the powder inlet tube 46 is positioned at an angle of about 23° relative to the longitudinal axis of the throughbore 42 in rearward barrel member 34. It has been found that this angle is optimum, and in any event should be less than about 30°, in order to allow the particulate powder material to flow freely around the barrel liner 84. This reduces impact fusion of the particulate powder material on the barrel liner 84, and other internal surfaces of spray gun 10, as well as wear on such parts. Additionally, impact fusion and wear is reduced by forming the powder inlet tube 46 with a relatively large diameter which reduces the velocity of the particulate powder material as it enters the spray gun 10.

In another aspect of this invention, the powder flow path formed by the throughbore in the rearward barrel member 34, forward barrel member 56 and nozzle 110 is designed to ensure thorough mixing of the powder material throughout the cross section thereof. The diameter of the rearward and forward barrel members 34, 56 remain constant from the angled bore 44 forwardly to mix the powder material and maintain its velocity through the spray gun. The diameter of the forward barrel member 56 increases upstream of its forward end, beginning at the tapered portion 76, in order to decrease the powder velocity. This decrease in the powder velocity is needed to help overcome the effect of the radial connectors 97 of cable liner mount 92 which are disposed directly in the path of the powder and tend to disrupt the uniformity of the powder stream. Additionally, the portion of throughbore 114 of nozzle 110 immediately downstream from cable liner mount 92 has an enlarged diameter followed by the hourglass-shaped portion 116, which have the combined effect of thoroughly mixing the powder into a uniform stream prior to its emission from the discharge opening 118 of nozzle 110.

Referring now to FIG. 3, the procedure for assembling the powder spray gun 10 is illustrated, it being understood that disassembly would be accomplished by reversing the order of such steps. Initially, the rearward barrel member 34 is slid into the cavity 30 formed in the base 14 of mounting block 12. A friction fit is formed between the O-rings 40, 41 carried on the outer surface of the rearward barrel member 34 and the walls of the cavity 30 in the mounting block 12. The barrel liner 84 is then inserted into the rearward barrel member 34 so that its rearward end rests on the seat 86 formed in the rearward barrel member 34. As mentioned above, the barrel liner 84 receives substantially the entire length of the cable liner 28 and electrostatic cable 26.

The threaded rearward end of forward barrel member 56 is then connected to the correspondingly threaded forward end of the rearward barrel member 34. In addition to this threaded connection, the O-ring 64 carried on the rearward end of forward barrel member 56 slides along the inner wall formed by the stepped throughbore 42 in rearward barrel member 34 creating a friction fit therebetween.

The cable liner support 92 is then fitted over the forward end of forward barrel member 56 and into engagement with the annular shoulder 82. The cable liner support 92 has a reduced diameter ring 95 through which the forward portion of the cable liner 28 extends. The cable liner support 92 thus functions to center the cable liner 28 and electrostatic cable 26 in the proper position at the forward end of the spray gun 10.

The pattern adjustment sleeve 100 is then slid onto the outer surface of forward barrel member 56. The O-ring 108 carried on the inner wall of pattern adjustment sleeve 100 forms a friction fit with the outer surface of forward barrel member 56. The nozzle 110 is next inserted within the pattern adjustment sleeve 100 onto the outer surface of forward barrel member 56 where it is held in place by the two O-rings 124, 125 carried at the forward end of forward barrel member 56.

The powder inlet tube 46 is inserted through the inlet sleeve 22 formed in the mounting block 12 and into the angled bore 44 formed in the rearward barrel member 34. The forward end of powder inlet tube 46 has an O-ring 50 which forms a seal between the powder inlet tube 46 and rearward barrel member 34. The powder inlet tube 46 is held in place by the engagement of detent 51 of the retainer 52 with groove 53 of tube 46. The retainer 52 is fitted onto the base 14 of mounting block 12 and then secured into place on the rearward barrel member 34 by the screw 54.

The assembly procedure described above in connection with FIG. 3 is simply reversed to disassemble the spray gun 10 for cleaning. As shown in FIG. 3, all of the parts which come into contact with particulate powder material are formed with generally straight internal and external surfaces which are easily accessible by a blast or stream of air for cleaning them. This greatly simplifies the cleaning procedure in converting from one color of particulate powder material to another. Additionally, the sliding, friction fits provided for connecting most of the parts together, i.e., using O-rings, greatly reduces the time and effort required to assemble or disassemble the spray gun 10.

While the invention has been described with reference to a preferred embodiment, it should be understood by those skilled in the art that various changes may be made and equivalents may be substituted for elements thereof without departing from the scope of the invention. In addition, many modifications may be made to adapt a particular situation or material to the teachings of the invention without departing from the essential scope thereof.

For example, the precise order of assembly or disassembly of the parts shown in FIG. 3 is not critical to the essential scope of this invention. The barrel liner 84, for example, may be inserted in place within the rearward barrel member 34 after the forward barrel member 56 is assembled. Other changes of this nature may also be made in the assembly or disassembly procedure as desired.

Therefore, it is intended that the invention not be limited to the particular embodiment disclosed as the best mode contemplated for carrying out this invention, but that the invention will include all embodiments falling within the scope of the appended claims.

We claim:

1. A powder spray gun adapted for easy assembly and disassenbly, comprising:

a mounting block having an inlet sleeve, a cavity and means for mounting to a support rod;

a barrel member releasably mounted within said cavity of said mounting block, said barrel member being formed with a throughbore and a powder inlet passageway intersecting said throughbore;

a powder inlet tube releasably mounted within said powder inlet passageway of said barrel member, said powder inlet tube being adapted to connect to a supply line from a source of particulate powder material;

a cable assembly including a cable liner having a hollow interior and an electrostatic cable mounted within at least a portion of said hollow interior of said cable liner, one end of said cable assembly being mounted to said inlet sleeve of said mounting block and extending outwardly from said mounting block through said cavity thereof and into said throughbore of said barrel member;

said barrel member being slidably disengageable from said cable assembly and said mounting block, respectively while said mounting block and cable assembly remain assembled.

2. A powder spray gun adapted for easy assembly and disassembly, comprising:

a mounting block formed with an inlet sleeve, a cavity and means for mounting to a support rod;

a barrel member slidably and frictionally mounted within said cavity of said mounting block, said barrel member being formed with a throughbore defining an inner wall and a powder inlet passageway intersecting said througbore, said powder inlet passageway being adapted to be connected to a source of particulate powder material;

a barrel liner having a throughbore and an outer wall, said barrel liner being slidably and frictionally mounted within said throughbore of said barrel member forming a powder flow passageway between said outer wall of said barrel liner and said inner wall of said barrel member;

a cable assembly including a cable liner having a hollow interior and an electrostatic cable mounted within said hollow interior of said cable liner, one end of said cable assembly being mounted to said inlet sleeve of said mounting block and extending outwardly from said mounting block through said cavity thereof and into said throughbore of said barrel member;

a deflector slidably and frictionally mounted to said outer end of said cable assembly, said deflector having an electrode in electrical contact with the electrostatic cable carried within said cable liner of said cable assembly;

said deflector, said barrel member and said barrel liner being slidably disassembled for cleaning of particulate powder material therefrom, while said cable assembly and said mounting block remain assembled.

3. A powder spray gun adapted for easy assembly and disassembly, comprising:

a mounting block formed with an inlet sleeve, a cavity and means for mounting to a support rod;

a cable assembly including a cable liner having a hollow interior and an electrostatic cable mounted within said hollow interior of said cable liner, one end of said cable assembly being mounted to said inlet sleeve of said mounting block and extending outwardly from said mounting block through said cavity thereof;

a rearward barrel member slidably and frictionally mounted within said cavity of said mounting block, said rearward barrel member being formed with a throughbore which receives said cable assembly and a powder inlet passageway intersecting said throughbore;

a powder delivery tube adapted to be connected to a source of particulate powder material, said powder delivery tube being carried within said powder inlet passageway of said rearward barrel member;

a forward barrel member connected to said rearward barrel member, said forward barrel member being formed with an outer surface and a throughbore which receives said cable assembly;

a barrel liner having a throughbore which receives said cable assembly, said barrel liner being slidably and frictionally mounted at one end by said rearward barrel member and extending outwardly therefrom within said throughbore of each said forward and rearward barrel members;

a nozzle slidably and frictionally mounted on said outer surface of said forward barrel member, said nozzle being formed with a throughbore which receives said cable assembly;

a cable liner mount slidably and frictionally mounted on said outer surface of said forward barrel member and extending into said throughbore of said nozzle, said cable liner mount being formed with a throughbore defining an inner wall which supports the other end of said cable assembly;

a deflector slidably and frictionally mounted to said other end of said cable assembly, said deflector having an electrode in electrical contact with the electrostatic cable carried within said cable liner of said cable assembly.

4. A powder spray gun adapted for easy assembly and disassembly, comprising:

a mounting block formed with an inlet sleeve, a cavity and means for mounting to a support rod;

a cable assembly including a cable liner having a hollow interior and an electrostatic cable mounted within said hollow interior of said cable liner, one end of said cable assembly being mounted to said inlet sleeve of said mounting block and extending outwardly from said mounting block through said cavity thereof;

a rearward barrel member carried within said cavity of said mounting block, said rearward barrel member being formed with a throughbore which receives said cable assembly and a powder inlet passageway intersecting said throughbore;

a powder delivery tube adapted to be connected to a source of particulate powder material, said powder delivery tube being carried within said powder inlet passageway of said rearward barrel member;

a forward barrel member connected to said rearward barrel member, said forward barrel member being formed with an outer surface and a throughbore which receives said cable assembly;

a barrel liner having a throughbore which receives said cable assembly, said barrel liner being carried at one end by said rearward barrel member and extending outwardly therefrom within said throughbore of each said forward and rearward barrel members;

a nozzle carried on said outer surface of said forward barrel member, said nozzle being formed with a throughbore which receives said cable assembly;

a cable liner mount carried on said outer surface of said forward barrel member and extending into said throughbore of said nozzle, said cable liner mount being formed with a throughbore defining an inner wall which supports the other end of said cable assembly;

a deflector mounted to said other end of said cable assembly, said deflector having an electrode in electrical contact with the electrostatic cable carried within said cable liner of said cable assembly.

5. The powder spray gun of claim 4 including a pattern adjustment sleeve carried on said outer surface of said forward barrel member, said pattern adjustment sleeve being formed with a throughbore which receives said nozzle.

6. The powder spray gun of claim 5 in which said pattern adjustment sleeve has an inner wall formed by said throughbore, said inner wall being formed with at least one groove which mounts an O-ring, said pattern adjustment sleeve being slid onto said outer surface of said forward barrel member so that said O-ring engages said outer surface to retain said pattern adjustment sleeve on said forward barrel member.

7. The powder spray gun of claim 4 in which said powder delivery tube is positioned on an angle of about 23° relative to the longitudinal axis of said throughbore formed in said rearward barrel member.

8. The powder spray gun of claim 4 in which the diameter of said forward barrel member increases upstream from said cable liner mount to decrease the velocity of particulate powder material flowing through said forward barrel member.

9. The powder spray gun of claim 4 in which said cavity forms an inner wall in said mounting block, said rearward barrel member including an outer surface which carries at least one O-ring, said O-ring engaging said inner wall of said cavity of said mounting block for slidably retaining said rearward barrel member within said cavity.

10. The powder spray gun of claim 4 in which said mounting block is formed with a stepped bore forming an inner wall and an annular seat, said one end of said barrel liner being mounted upon said seat formed in said mounting block, an O-ring being mounted within a groove formed in said inner wall of said mounting block in a position wherein said O-ring engages said barrel liner to retain said barrel liner upon said seat.

11. The powder spray gun of claim 4 in which said forward barrel member includes a forward end formed with at least one annular groove which mounts an O-ring, said nozzle being positioned over said forward end of said forward barrel member so that said O-ring engages the wall formed by said throughbore in said nozzle to retain said nozzle on said forward barrel member.

12. The powder spray gun of claim 4 in which said throughbore in said nozzle forms an annular shoulder, said cable liner mount having a forward end which engages said annular shoulder of said nozzle to retain said cable liner mount on said forward end of said forward barrel member.

13. A powder spray gun for spraying particulate powder material, comprising:

a mounting block;

a cable assembly including a cable liner having a hollow interior and an electrostatic cable mounted within said hollow interior of said cable liner;

a gun barrel carried by said mounting block, said gun barrel being formed with a powder flow passageway and a powder inlet passageway which intersects said powder flow passageway at an angle of less than about 30° relative to the longitudinal axis of said powder flow passageway;

a hollow barrel liner which receives said cable assembly, said barrel liner and cable assembly being mounted within said powder flow passageway of said gun barrel;

a powder delivery tube connected to said powder inlet passageway and adapted to connect to a source of air-entrained particulate powder material, said powder delivery tube transmitting particulate powder material to said powder inlet passageway and into said powder flow passageway at said angle of less than 30° so that the particulate powder material is thoroughly mixed about said barrel liner within said powder flow passageway.

14. The powder spray gun of claim 13 in which said angle of said powder inlet passageway is about 23°.

* * * * *

UNITED STATES PATENT AND TRADEMARK OFFICE

CERTIFICATE OF CORRECTION

PATENT NO. : 4,815,666

DATED : March 28, 1989

INVENTOR(S) : Mark Gacka et al

It is certified that error appears in the above-identified patent and that said Letters Patent is hereby corrected as shown below:

In column 2, line 56, "t" should be --to--.

In column 2, line 61, after "filed", insert --May 27, 1987, and--.

In column 4, line 64, "o" should be --to--.

In column 9, line 42, "disassenbly" should be --disassembly--.

Signed and Sealed this

Fifth Day of December, 1989

*Attest:*

JEFFREY M. SAMUELS

*Attesting Officer*

*Acting Commissioner of Patents and Trademarks*